US011077337B1

(12) United States Patent
Majkrzak

(10) Patent No.: US 11,077,337 B1
(45) Date of Patent: Aug. 3, 2021

(54) CHEST PEAK CONTRACTOR

(71) Applicant: Lawrence Majkrzak, Passaic, NJ (US)

(72) Inventor: Lawrence Majkrzak, Passaic, NJ (US)

( * ) Notice: Subject to any disclaimer, the term of this patent is extended or adjusted under 35 U.S.C. 154(b) by 147 days.

(21) Appl. No.: 16/668,726

(22) Filed: Oct. 30, 2019

Related U.S. Application Data

(60) Provisional application No. 62/917,978, filed on Jan. 9, 2019.

(51) Int. Cl.

| | |
|---|---|
| ***A63B 23/02*** | (2006.01) |
| ***A63B 21/00*** | (2006.01) |
| ***A63B 21/06*** | (2006.01) |
| ***A63B 21/08*** | (2006.01) |

(52) U.S. Cl.
CPC ..... *A63B 23/02* (2013.01); *A63B 21/0615* (2013.01); *A63B 21/08* (2013.01); *A63B 21/4035* (2015.10); *A63B 2225/093* (2013.01)

(58) Field of Classification Search
CPC ..... A63B 21/00058; A63B 21/00061; A63B 21/00065; A63B 21/00069; A63B 21/00072; A63B 21/0615; A63B 21/0616; A63B 21/0617; A63B 21/078; A63B 21/08; A63B 21/15; A63B 21/159; A63B 21/4027; A63B 21/4033; A63B 21/4035; A63B 21/4045; A63B 21/4047; A63B 21/4049; A63B 23/02; A63B 23/035; A63B 23/03516; A63B 23/03533; A63B 23/03541; A63B 23/12; A63B 23/1209; A63B 23/1245; A63B 23/1254; A63B 23/129; A63B 2225/09; A63B 2225/093; A63B 2244/09
See application file for complete search history.

(56) References Cited

U.S. PATENT DOCUMENTS

| | | | | | |
|---|---|---|---|---|---|
| 4,082,267 | A * | 4/1978 | Flavell | A63B 21/0053 | 185/37 |
| 4,621,623 | A * | 11/1986 | Wang | A63B 22/0076 | 482/73 |
| 4,730,829 | A | 3/1988 | Carlson | | |
| 4,772,015 | A | 9/1988 | Carlson et al. | | |
| 4,840,373 | A * | 6/1989 | Maag | A63B 21/0615 | 482/100 |
| 4,850,586 | A * | 7/1989 | Horvath | A63B 23/0355 | 482/72 |
| 5,092,581 | A * | 3/1992 | Koz | A63B 69/06 | 434/247 |

(Continued)

*Primary Examiner* — Gary D Urbiel Goldner
(74) *Attorney, Agent, or Firm* — Donald J. Ersler

(57) ABSTRACT

A chest peak contractor preferably includes a platform, a pair of stanchions, a pair of vertically adjustable telescoping poles and a pair of armature hand assemblies. The pair of stanchions extend upward from opposing sides of the platform. Each stanchion is sized to receive one of the vertically adjustable telescoping poles. A top of each telescoping pole is terminated with a pivoting joint. Each armature device handle assembly is mounted to a top of the respective telescoping pole. Each armature handle assembly preferably includes a handle, a proximal axle support tube, an armature crossbeam, a distal hanger, a pair of backstop rails, a ring bolt backstop, an axle, and a weight holder. The handle is rotatably retained in the pivoting joint. An end of the handle is secured to the proximal axle support tube.

19 Claims, 5 Drawing Sheets

(56) References Cited

U.S. PATENT DOCUMENTS 5,324,243 A * 6/1994 Wilkinson ..... A63B 21/055 482/121
5,788,614 A 8/1998 Simonson
6,120,421 A * 9/2000 Kuo ..... A63B 23/1209 482/111
6,234,941 B1 * 5/2001 Chu ..... A63B 23/12 482/100
7,169,093 B2 * 1/2007 Simonson ..... A63B 21/152 482/103
7,229,391 B2 * 6/2007 Francis ..... A63B 21/0455 482/127
7,811,211 B2 10/2010 Habing
7,833,138 B1 * 11/2010 Fulks ..... A63B 21/154 482/97
8,267,812 B1 * 9/2012 Sery ..... G09B 19/0038 473/409
10,799,756 B2 * 10/2020 Tuononen ..... A63B 23/1263
2001/0034289 A1 * 10/2001 Parrillo ..... A63B 23/035 482/94
2004/0147376 A1 * 7/2004 Gautier ..... A63B 23/03533 482/93
2006/0035764 A1 * 2/2006 Webber ..... A63B 23/1263 482/94
2006/0141434 A1 * 6/2006 Moran, Jr. ..... A63B 21/00178 434/252
2007/0054785 A1 * 3/2007 Drechsler ..... A63B 21/078 482/94
2007/0093363 A1 * 4/2007 Sharps ..... A63B 21/4049 482/94
2007/0160803 A1 * 7/2007 Grider ..... A63B 23/1209 428/100
2007/0161470 A1 * 7/2007 Berryman ..... A63B 21/00072 482/94
2007/0161471 A1 * 7/2007 Carter ..... A63B 23/1209 482/100
2007/0161472 A1 * 7/2007 Drechsler ..... A63B 21/4045 482/100
2008/0085820 A1 * 4/2008 Majkrzak ..... A63B 23/03533 482/92
2008/0139975 A1 * 6/2008 Einav ..... A63B 21/00181 601/33
2010/0009818 A1 * 1/2010 Simonson ..... A63B 21/154 482/97
2010/0285940 A1 * 11/2010 Douyere ..... A63B 22/0002 482/139
2013/0244804 A1 * 9/2013 Cochran ..... A63B 69/36211 473/218
2013/0337982 A1 * 12/2013 Williams ..... A63B 21/151 482/122
2016/0082305 A1 * 3/2016 Kurthy ..... A63B 21/0628 482/93
2016/0107022 A1 * 4/2016 Williams ..... A63B 21/00065 482/101
2016/0279459 A1 * 9/2016 Walker ..... A63B 23/1209
2017/0361165 A1 * 12/2017 Miller ..... A63B 69/3621
2018/0361200 A1 * 12/2018 Walker ..... A63B 21/4034
2019/0054346 A1 * 2/2019 Tuononen ..... A61H 1/0281

* cited by examiner

CHEST PEAK CONTRACTOR

CROSS-REFERENCES TO RELATED APPLICATIONS

This is a non-provisional application taking priority from provisional application No. 62/917,978 filed on Jan. 9, 2019.

BACKGROUND OF THE INVENTION

Field of the Invention

The present invention relates generally to exercise machines and more specifically to a chest peak contractor, which functions to adduct the humerus; medially rotate the humerus; and extend the humerus.

Discussion of the Prior Art

Adduction of the humerus; medially rotating the humerus; and extending the humerus are the functions, which are incorporated in the pose bodybuilders refer to as the "most muscular." This is the pose bodybuilders instinctively use when they want to showcase their chest because it contracts the most pectoral muscle fibers. Thus, it is logical to conclude that an exercise machine which provides resistance as it mimics this movement would be ideal in developing the pectoral muscles. You don't see bodybuilders press their arms forward as they would in performing a bench press or other chest exercise when they are competing. That is because each movement in the current repertoire of chest exercises is deficient in some regard in recruiting all of the pectoral muscle fibers.

The bench press and dips extend the humerus forward but do not adduct or medially rotate it. The pec deck and flyes adduct and extend the humerus but do not medially rotate it. The arm wrestling simulator medially rotates the humerus but does not extend or adduct it. The cable crossover machine is limited because in any movement other than a straight line the cable simply pivots at the pulley wheel instead of providing resistance in the new direction. But the Chest Peak Contractor is unique in exploiting all three dimensions for maximum muscle fiber engagement and contraction. And it provides freedom of motion for joint safety, variable leverage and full resistance at the point of peak contraction. Also, both overhand and underhand grips may be used.

U.S. Pat. No. 4,730,829 to Carlson discloses an exercise machine. U.S. Pat. No. 4,772,015 to Carlson et al. discloses a shoulder and arm exercise machine. U.S. Pat. No. 5,788,614 to Simonson discloses a plate-loaded chest press exercise machine and method of exercise. U.S. Pat. No. 7,811,211 discloses to Habing discloses a single apparatus converging/diverging exercise machine.

Accordingly, there is clearly felt need in the art for a chest peak contractor, which functions to adduct the humerus; medially rotate the humerus; and extend the humerus.

SUMMARY OF THE INVENTION

The present invention provides a chest peak contractor, which functions to adduct the humerus; medially rotate the humerus; and extend the humerus. The chest peak contractor preferably includes a platform, a pair of stanchions, a pair of telescoping poles and a pair of armature hand assembly. The pair of stanchions extend upward from opposing sides of the platform. Each stanchion is sized to receive a vertically adjustable telescoping pole. A top of each telescoping tube is terminated with a tee fitting. Each armature device handle assembly is mounted to a top of the telescoping pole. Each armature handle assembly preferably includes a handle, a proximal hanger, an armature crossbeam, a distal hanger, a pair of backstop rails, a ring bolt backstop, an axle, and a weight holder. The handle is rotatably retained in the tee fitting. An end of the handle is secured to the proximal axle support tube. One end of the armature crossbeam is secured to the proximal axle support tube and an opposing end is secured to the distal hanger. The pair of back stop rails are slidably retained in the armature crossbeam. The ring bolt is retained on the pair of back stop rails. One end of the axle is retained in a bottom of the proximal hanger and an opposing end is retained in the distal hanger. One end of the weight holder is rotatably retained on the axle. A weight hanger extends outward from a bottom of the weight holder.

Accordingly, it is an object of the present invention to provide a chest peak contractor, which functions to adduct the humerus; medially rotate the humerus; and extend the humerus.

These and additional objects, advantages, features and benefits of the present invention will become apparent from the following specification.

DETAILED DESCRIPTION OF THE PREFERRED EMBODIMENTS

Figure 1:
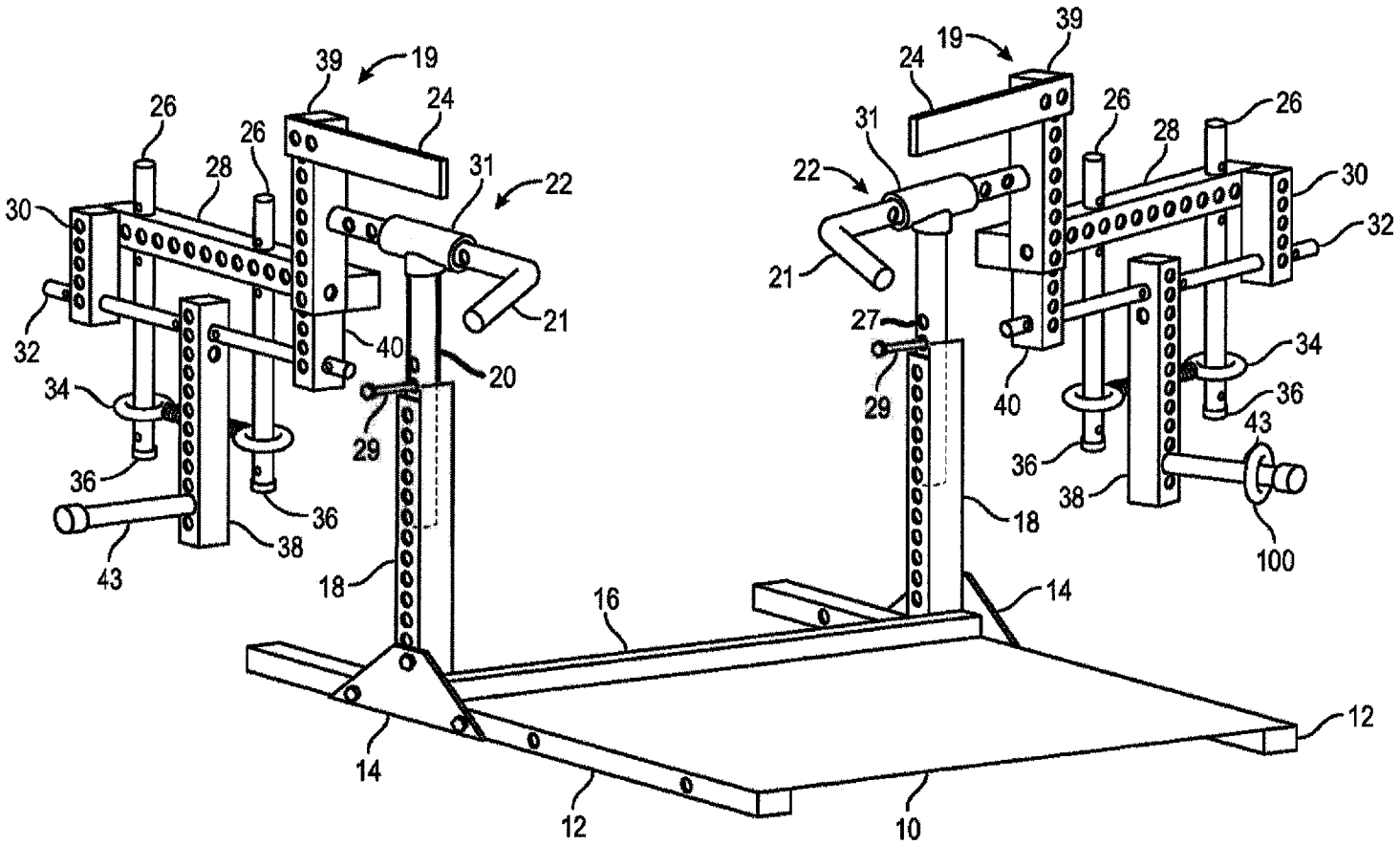
FIG. 1 is a perspective view of a chest peak contractor exercise machine in accordance with the present invention.

With reference now to the drawings, and particularly to FIG. 1, there is shown a chest peak contractor (1). The chest peak contractor (1) preferably includes steel tubing, pipe, and fittings. The chest peak contractor (1) preferably includes a platform (10) with crimped sides sits bolted atop two base tubes (12), which are connected to two stanchions (18) by two base braces (14). The stanchions (18) are also reinforced by the base cross beam (16). The stanchions (18) have the front side slightly elevated above the other three sides to restrict the rotational movement of the telescoping pole (20) which seats inside it. A plurality of holes (27) are formed through the telescoping pole (20) to accommodate an object, such as a pin (29), bolt or the like, which collides with this side if it is so desired. Holes in the stanchions (18) which correlate to holes (27) in the telescoping poles (20) restrict the rotation of the later element if it is so desired. Other holes in the stanchions (18) are for a pin or bolt to set the desired height of the telescoping pole (20) by supporting it from beneath.

Each telescoping pole (20) is terminated on top with a tee fitting (31). The tee fitting (31) rotatably retains a handle (21) of the armature handle assembly (22). The handle (21) is welded to the armature handle assembly (22). Further, a steel tube is also a part of the armature handle assembly (22) at its distal end through welding. Attached to a top of the armature handle assembly (22) at its distal end is a safety stop (24) which may be attached to either side. Telescoping inside an outer proximal tube (39) of a proximate hanger (19) is a proximal axle support tube (40) which may be raised or lowered as desired. One end of an armature crossbeam (28) is attached to a bottom of an outer proximal tube (39) and an opposing end is attached to a top of the distal hanger (30). The armature crossbeam (28) slidably retains the two backstop rails (26). One end of the axle (32) is retained in the proximal axle support tube (40) and an opposing end is retained in the distal hanger (30).

The weight holder (38) is pivotally retained by the axle (32) and swings relative thereto. A weight projection (43) extends from a bottom of the weight holder (38) to retain a weight (100). The movement of the weight holder (38) is checked as the armature handle assembly (22) begins to turn by the ring bolt backstop (34) (which is formed by two ring bolts connected to each other with a fitting) that travels along the two backstop rails (26). As the armature handle assembly (22) moves the weight holders (38) beyond horizontal, the ring bolt backstop (34) slides down the backstop rails (26) as it maintains contact with the weight holder (38) and allows it to rotate to a horizontal position where it and the ring bolt backstop (34) are checked by the armature crossbeam (28). By offsetting the weight in this manner, maximum resistance is realized as the chest muscles are at peak contraction.

Figure 4:
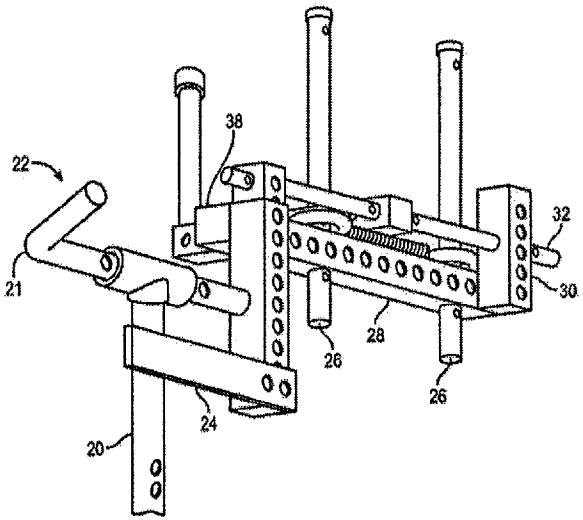
FIG. 4 is a perspective view of an armature handle assembly of a chest peak contractor exercise machine in a final stage of rotation in accordance with the present invention.
Figure 3:
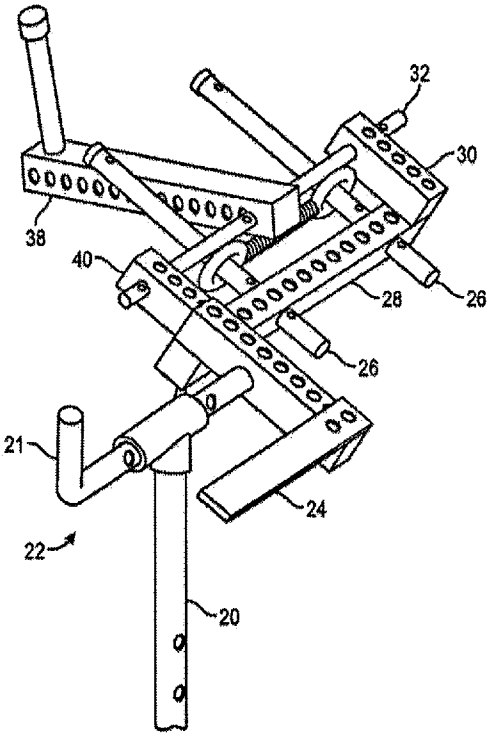
FIG. 3 is a perspective view of an armature handle assembly of a chest peak contractor exercise machine in a middle stage of rotation in accordance with the present invention.
Figure 2:
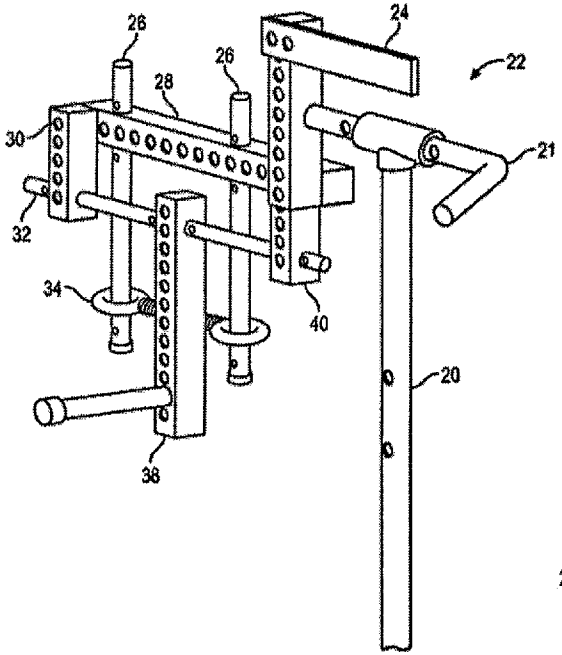
FIG. 2 is a perspective view of an armature handle assembly of a chest peak contractor exercise machine in an initial stage of rotation in accordance with the present invention.

FIGS. 2-4 show the positions of the armature handle assembly (22) in three stages of rotation: the beginning, middle and end of its path of motion respectively. The movement of the weight holder (38) is checked as the armature handle assembly (22) begins to turn by the ring bolt backstop (34) (which is formed by two ring bolts connected to each other with a fitting) that travels along the two backstop rails (26). As the armature handle assembly (22) moves the weight holders (38) beyond horizontal, the ring bolt backstop (34) slides down the backstop rails (26) as it maintains contact with the weight holder (38) and allows it to rotate to a horizontal position where it and the ring bolt backstop (34) are checked by the armature crossbeam (28). By offsetting the weight in this manner, maximum resistance is realized as the chest muscles are at peak contraction.

In operation, the exerciser loads the weight holder (38) with the desired amount of weight. The height of the telescoping pole (20) is adjusted by pins or bolts to suit the height of the exerciser. The height of the axle (32) is adjusted by bolts located on the proximal axle support tube (40) and the distal hanger (30). The position of the armature crossbeam (28) is adjusted so that the weight holder (38) will be in the range of a right angle to it and supported by it when the armature handle assembly (22) is rotated fully. The backstop rails (26) are adjusted so that the ring bolt backstop (34) supports the weight holder (38). The movement of the weight holder (38) is checked as the armature handle assembly (22) begins to turn by the ring bolt backstop (34) that travels along the two backstop rails (26).

As the armature handle assembly (22) moves the weight holder (38) beyond horizontal, the ring bolt backstop (34) slides down the backstop rails (26) as it maintains contact with the weight holder (38) and allows it to rotate to an approximately horizontal position where it and the ring bolt backstop (34) are checked by the armature crossbeam (28). By offsetting the weight in this manner, maximum resistance is realized as the chest muscles are at peak contraction. An object, such as a bolt, pin or the like may be attached by placing thereof in one of the top holes of the telescoping pole (20) to catch the taller front side of the stanchion (18) and therefore limit the amount of rotation of the telescoping pole (20). This will keep the armature handle assembly (22) from backsliding inwards too far and still permit the armature handle assembly (22) to be rotated fully. A pin may also be inserted through both the stanchion (18) and telescoping pole (20) to stop them from rotating. This may be desirable if the telescoping poles (20) are lowered and a bench placed between them to perform traditional flyes.

An object, such as a pin, bolt or the like is inserted through a hole in the stanchion (18) and underneath the telescoping pole (20) to support the telescoping pole (20) at the proper height. Bolts or screw-on caps may be used to retain the ring bolt backstop (34) along the backstop rails (26) and round rubber donuts or springs may fitted to the backstop rails (26) to dampen sound. The exerciser then rotates the handle (21) of the armature handle assembly (22) inwards in a rowing motion as the right arm is being turned counterclockwise for an underhand grip approximately 180 degrees and the safety stop (24) contacts the telescoping pole (20). Adduction of the humerus is produced by bringing the handle of the armature handle assembly (22) inwards in a rowing motion at the same time it is being turned.

Figure 5:
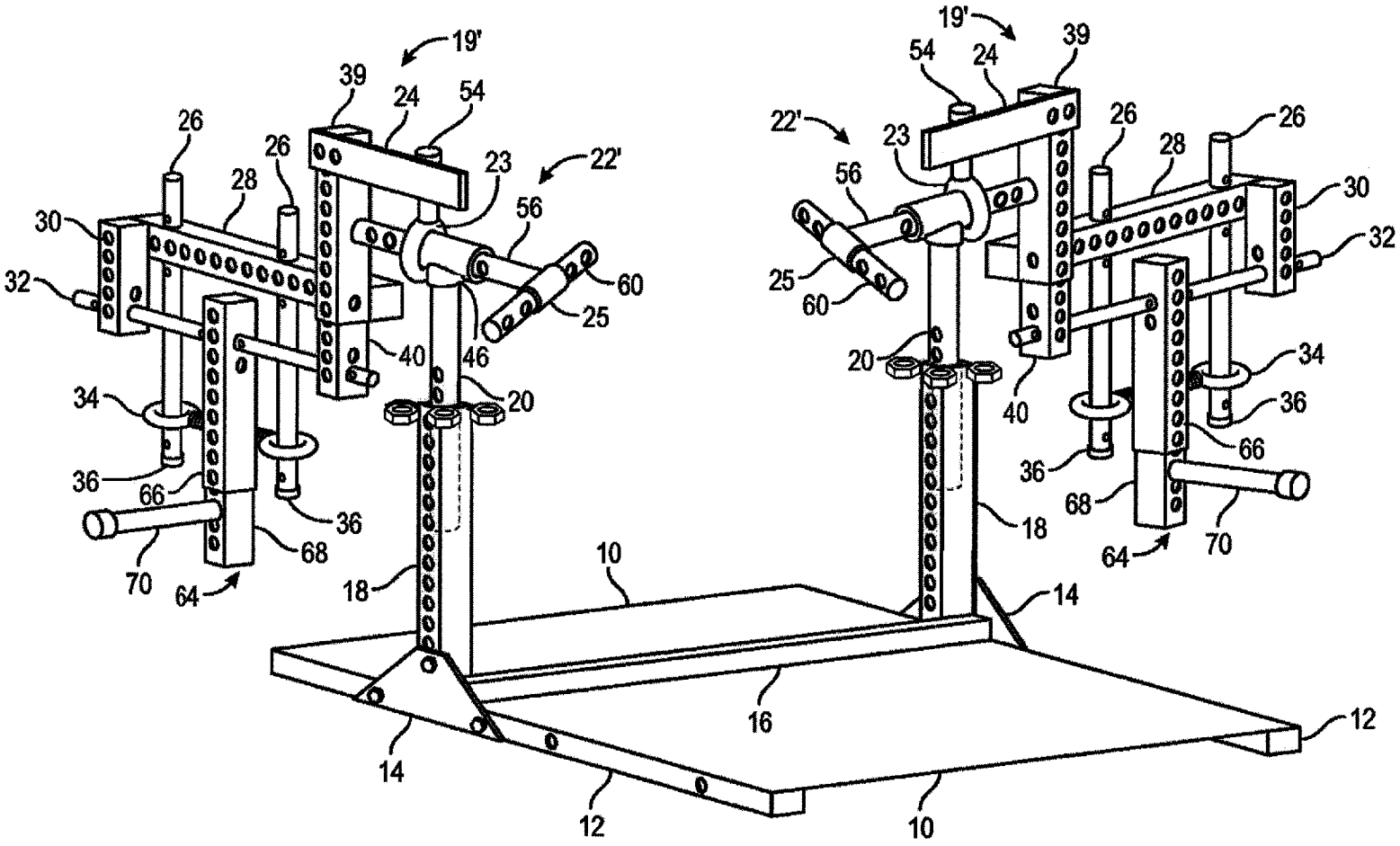
FIG. 5 is a perspective view of a second embodiment of a chest peak contractor exercise machine in accordance with the present invention.

FIG. 5 shows a second embodiment of a chest peak contractor (2). The chest peak contractor (2) preferably employs steel tubing, pipe, and fittings. The chest peak contractor (2) includes two platforms (10) with crimped sides that sit bolted atop two base tubes (12), which are connected to two stanchions (18) by two base braces (14). The stanchions (18) are also reinforced by the base cross beam (16). The stanchions (18) have four bolt nuts welded to their front and back in which bolts may be vertically screwed to catch an object, such as a horizontal pin, bolt or like is attached in the hole in the telescoping pole (20) which accommodates it. This will restrict the armature handle assembly (22) and telescoping pole (20) from backsliding when heavier weights are employed. Holes in the stanchions (18) correlate to holes in the telescoping poles (20) and can completely restrict the rotation of the later element if it is so desired. Other holes in the stanchions (18) are for an object, such as a pin, bolt or the like to set the desired height of the telescoping pole (20) by supporting it from beneath.

A top of the telescoping poles (20) are terminated with the tee fitting (46). Welded onto the bottom of the tee fitting (46) is a U-bolt (50) through which has been fitted in the welding process a ring bolt brace (23). The ring bolt brace (23) rotates around a distal extension of the tee fitting (46), while a ring bolt shaft (52) fits into a pipe (54) welded onto the proximal side of the safety stop (24). The ring bolt shaft (52) and the pipe (54) form a reinforcing brace for the armature handle assembly (22').

The armature handle assembly (22') is also equipped with the tee fitting holes (58) formed through a rotation member (56) on either side of the tee fitting (46) to accommodate different shoulder widths of the exerciser. The tee fitting holes (58) are mirrored by changes in length selections of the safety stop [24]. A handle tee fitting (25) is attached to an end of the rotation member (56). The handle tee fitting (25) is sized to slidably receive a handle (60). The handle (60) may be secured in placed through by pins or bolts inserted into holes (62) along its length. The adjustable handle (60) accommodates various grip widths and alternating between an underhand grip and an overhand grip. The desired result of these adjustments is a comfortable grip within the parameters of the humerus always in a vertical position and the end of the handle (60) meeting at the midline. With a telescoping weight holder (64) always oriented outward, an underhanded grip is utilized by standing on one platform side and turning the right handle (60) counterclockwise and the left handle (60) clockwise. For an overhand grip, the exerciser simply retracts the handle (60), reverses sides and turns the now right handle (60) clockwise and the now left handle (60) counterclockwise.

Figure 6:
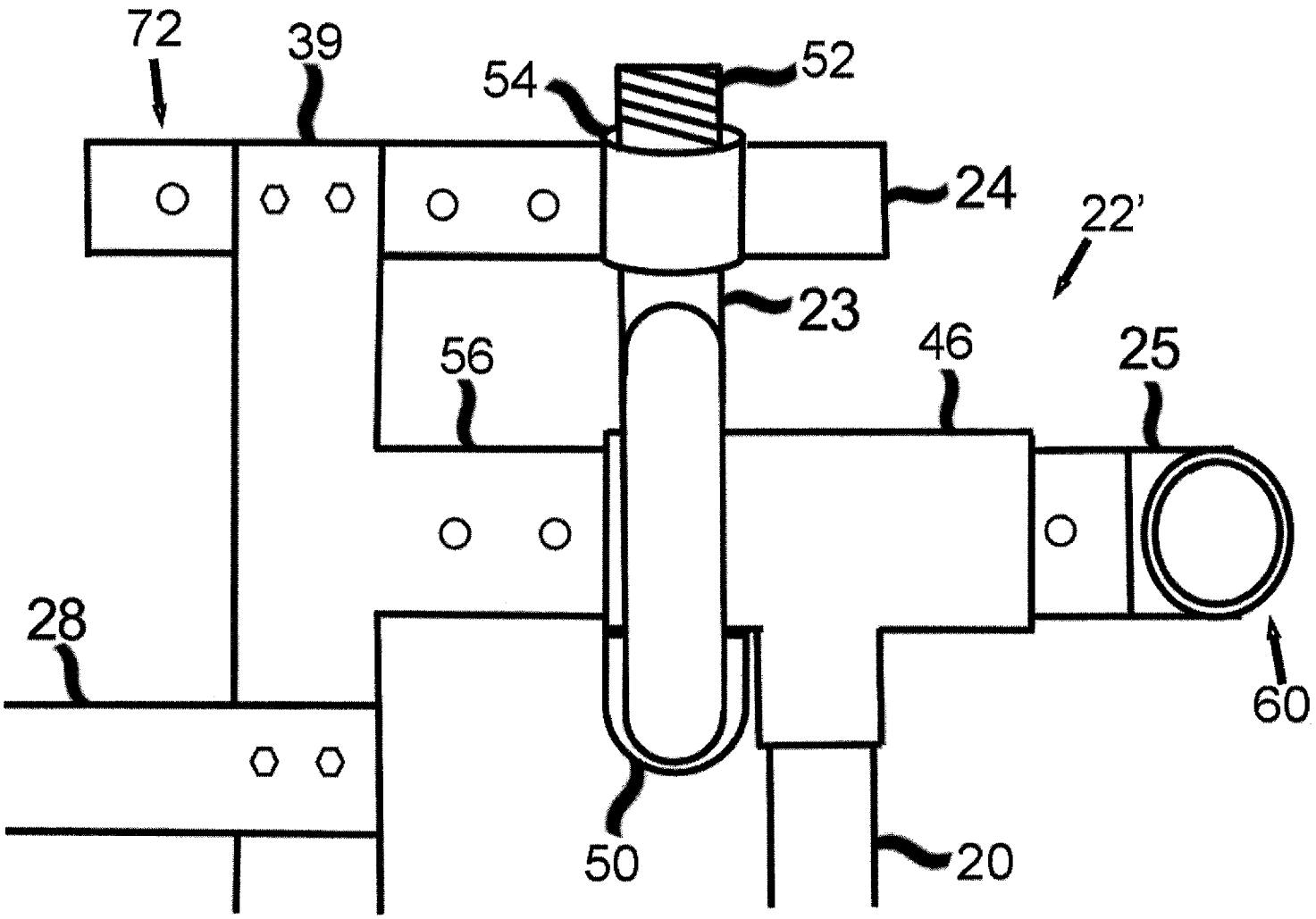
FIG. 6 is a side view of a ring bolt brace of a second embodiment of a chest peak contractor in accordance with the present invention.

With reference to FIG. 6, the safety stop (24) is attached to a top of the proximal outer tube (39) with at least one fastener (72). The safety stop (24) prevents the armature handle assembly (22') from rotating beyond approximately 180 degrees. Telescoping inside the proximal outer tube (39) of the armature handle assembly (22) is proximal axle support tube (40) which may be raised or lowered as desired. The armature crossbeam (28) is attached to the bottom of the proximal outer tube (39) of the armature handle assembly (22) and it suspends the two backstop rails (26) and the distal hanger (30), which along with the proximal axle support tube (40) house the axle (32).

A telescoping weight holder (64) swings on the axle (32). The telescoping weight holder (64) includes an outer tube (66), an inner tube (68) and a weight projection (70). The inner tube (68) telescopes within the outer tube (66). The weight projection (70) extends from a bottom of the inner tube (68). The movement of the telescoping weight holder (64) is checked as the armature handle assembly (22') begins to turn by the ring bolt backstop (34) that travels along the two backstop rails (26). As the armature handle assembly (22) moves the telescoping weight holder (64) beyond horizontal, the ring bolt backstop (34) slides down the backstop rails (26) as it maintains contact with the telescoping weight holder (64) and allows it to rotate to a horizontal position where it and the ring bolt backstop (34) are checked by the armature crossbeam (28). By offsetting the weight in this manner, maximum resistance is realized as the chest muscles are at peak contraction. Situated below the backstop rails (26), the telescoping weight holder (64) may be oriented parallel to the shaft of the armature handle assembly (22'), and with a pin or spacer to keep the weights outside the confines of the backstop rail (26), larger diameter weight plates may be employed.

Figure 7:
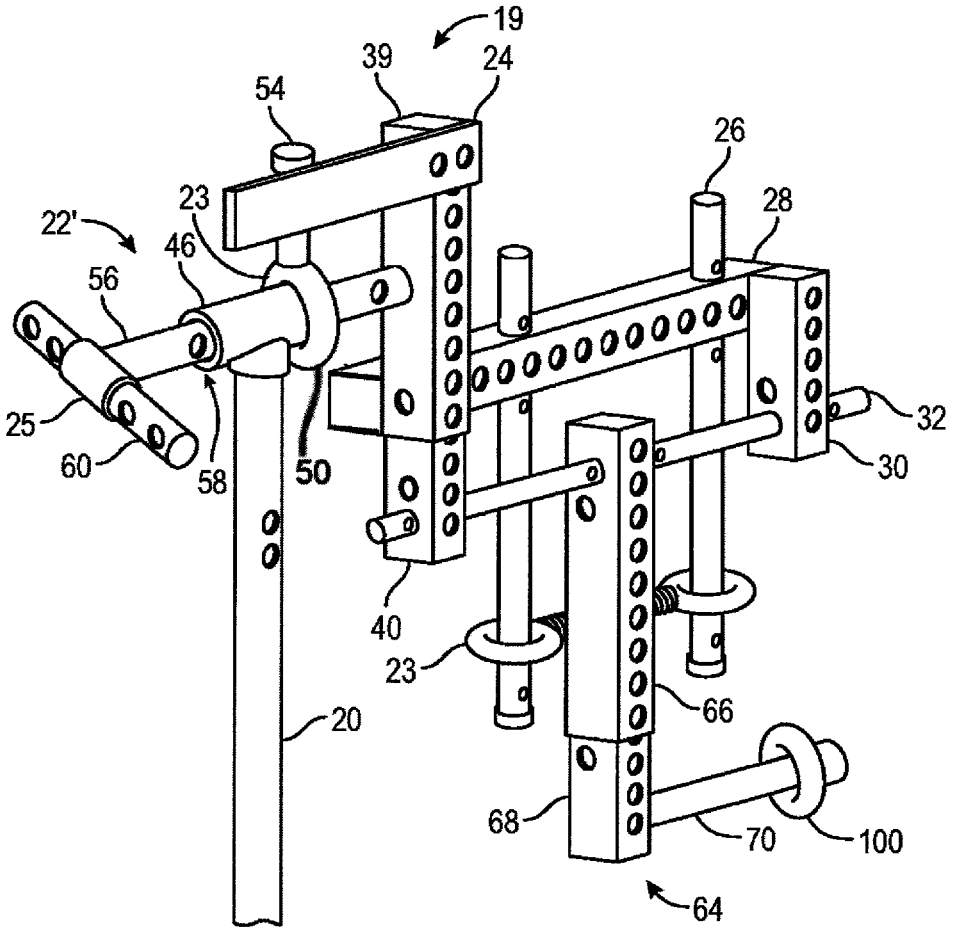
FIG. 7 is a perspective view that an alternative embodiment of an armature handle assembly of a peak contractor exercise machine in accordance with the present invention.

FIG. 6 is a side view of the ring bolt brace (23) which passes through a U-bolt (50), which has been welded to the tee fitting (46) and the pipe (54) has been welded to the safety stop (24). A nut (not shown) on the ring bolt shaft (52) locks the ring bolt brace (23) in place. FIG. 7 is a perspective view of the armature handle assembly (22'). The pivotal engagement of the telescoping weight holder (64) with the axle (32) has been rotated 90 degrees so that larger diameter weights 100 may be used. The leverage may be changed by raising or lowering the inner tube (68).

In use, the exerciser adjusts a height of the telescoping pole (20) through pins that run beneath it and through the stanchions (18) that house it. A desired width of the handles (60) is obtained by sliding the rotation member (56) of the armature handle assembly (22) horizontally and securing it with bolts or pins that run through fitting holes (58) along the rotation member (56). The safety stop (24) and the handles (60) are adjusted to mirror these settings, so that at full rotation of the armature handle assembly (22), the safety stop (24) communicates with the telescoping pole (20) as it secures the ring bolt brace (23) and the ends of the handles (60) meet at the approximate midline of the exerciser. The inner tube (68) of the telescoping weight holder (64) is oriented to accommodate a diameter of the weight plates being used. If an underhanded grip is desired, the exerciser stands on the side of the machine whereby the right-hand handle is turned counterclockwise. If an overhand grip is desired, the exerciser stands on the opposite side of the machine whereby the now right-hand handle is turned clockwise. In other words, the exerciser retracts the handle, secures it with bolts and simply switches sides. Now the exerciser raises the handle vertically to approximately 90 degrees and then horizontally turns it inward as they simultaneously complete the vertical rotation to approximately 180 degrees.

Thus, the reader will see that at least one embodiment of the Chest Peak Contractor provides greater pectoral muscle fiber engagement for maximum results. While my above description contains many specificities, these should not be construed as limitations on the scope of the invention, but rather as an exemplification of one preferred embodiment thereof. Many other variations are possible. For example, a ball roller could be pressed in the lower end of the telescoping pole (20) for smoother articulation with the pins inserted for support through the stanchion (18). Holes for bolts or pins may also be drilled through the weight projection (70) for extra insurance that the weight plates do not travel, or the weight projection (70) may be threaded so that a nut or cap may be screwed on.

In addition, ball bearing rings or rollers may be used instead of, or in addition to, ring bolts in the ring bolt backstop. Provision may be made through threaded piping and fittings to additionally adapt the armature handle assembly (22) for performing traditional flyes, such as an L-shape configuration. It is also possible to configure the invention so that the two backstop rails (26) move up and down and the ring bolt backstop (34) act as a retainer. Straps or hand guards may be added to the armature handle assembly (22) and the handle (21) as a further safety precaution. Also, the exerciser has the option to disable the weight-offset dynamic by running another axle (32) through the distal hanger (30), proximate hanger (19), and weight holder (64) on each side. The pair of axles (32) would prevent the weight holder (64) from rotating. Alternatively, the inner tube (68) can be attached directly to the proximal outer tube (39), and the armature crossbeam (28), the two backstop rails (26), the distal hanger (30), the axle (32), the ring bolt backstop (34), the pipe caps (36) and the proximal axle support tubes (40) may be detached from the armature handle assembly (22). An object, such as a bolt, pin or the like is attached by placing thereof in one of the top holes of the telescoping pole (20) to catch the taller front side of the stanchion (18) and therefore limit the amount of rotation of the telescoping pole (20) so that it doesn't fall back and makes productive rotational movements of the armature handle assembly (22) possible.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A chest peak contractor comprising:

a support member; and at least one armature handle device including a rotation member, a first hanger, a second hanger, an armature crossbeam, at least one axle and a weight holder, said rotation member is rotationally engaged with said support member, one end of said rotation member extends from said first hanger, a first end of said armature crossbeam is attached to said first hanger, a second end of said armature crossbeam is attached to said second hanger, a first end of said at least one axle is retained in said first hanger, a second end of said at least one axle is retained in said second hanger, said weight holder is retained on said at least one axle.

2. The chest peak contractor of claim 1 wherein:

said support member includes a platform and at least one telescoping pole, said at least one telescoping pole extends upward from said platform, said rotation member is rotationally engaged with a top of said at least one telescoping pole, respectively.

3. The chest peak contractor of claim 2 wherein:

the top of said at least one telescoping pole is terminated with a tee fitting, said rotation member is rotatably retained in said tee fitting, respectively.

4. The chest peak contractor of claim 1 wherein:

a handle extends from an opposing end of said rotation member.

5. The chest peak contractor of claim 1 wherein:

said first hanger includes a proximal outer tube and a proximal axle support tube, said proximal axle support tube is slidably received by said proximal outer tube, said first end of said armature crossbeam is attached to said proximal outer tube, said at least one axle is retained in said proximal axle support tube.

6. The chest peak contractor of claim 1 wherein:

said weight holder includes an outer tube, an inner tube and a weight projection, said outer tube is pivotally retained on said at least one axle, said outer tube is sized to receive said inner tube, said weight projection extends from a bottom of said inner tube.

7. The chest peak contractor of claim 1 wherein:

said at least one armature handle device is prevented from rotation by at least one object attached to said support member.

8. A chest peak contractor comprising:

a support member; and an armature handle device including a rotation member, a first hanger, a second hanger, an armature crossbeam, at least one axle, a weight holder and two backstop rails, said rotation member is rotationally engaged with said support member, one end of said rotation member extends from said first hanger, a first end of said armature crossbeam is attached to said first hanger, a second end of said armature crossbeam is attached to said second hanger, a first end of said at least one axle is retained in said first hanger, a second end of said at least one axle is retained in said second hanger, said weight holder is retained on said at least one axle, said two backstop rails are retained in said armature crossbeam, a ring bolt backstop is slidaby retained on said two backstop rails, wherein said ring bolt backstop prevents said weight holder from rotating.

9. The chest peak contractor of claim 8 wherein:

said support member includes a platform and at least one telescoping pole, said at least one telescoping pole extends upward from said platform, said rotation member is rotationally engaged with a top of one of said at least one telescoping pole.

10. The chest peak contractor of claim 9 wherein:

the top of said at least one telescoping pole is terminated with a tee fitting, said rotation member is rotatably retained in said tee fitting.

11. The chest peak contractor of claim 8 wherein:

a handle extends from an opposing end of said rotation member.

12. The chest peak contractor of claim 8 wherein:

said first hanger includes a proximal outer tube and a proximal axle support tube, said proximal axle support tube is slidably received by said proximal outer tube, said first end of said armature crossbeam is attached to said proximal outer tube, said at least one axle is retained in said proximal axle support tube.

13. The chest peak contractor of claim 8 wherein:

said weight holder includes an outer tube, an inner tube and a weight projection, said outer tube is pivotally retained on said at least one axle, said outer tube is sized to receive said inner tube, said weight projection extends from a bottom of said inner tube.

14. The chest peak contractor of claim 8 wherein:

said armature handle device is prevented from rotation by at least one object attached to said support member.

15. A chest peak contractor comprising:

a support member; and an armature handle device including a rotation member, a first hanger, a second hanger, an armature crossbeam, at least one axle, a weight holder and a safety stop, said rotation member is rotationally engaged with said support member, one end of said rotation member extends from said first hanger, a first end of said armature crossbeam is attached to said first hanger, a second end of said armature crossbeam is attached to said second hanger, a first end of said at least one axle is retained in said first hanger, a second end of said at least one axle is retained in said second hanger, said weight holder is retained on said at least one axle, said safety stop extends from said first hanger, wherein said safety stop will strike said support member to prevent said armature handle device from being over rotated.

16. The chest peak contractor of claim 15 wherein:

said support member includes a platform and at least one telescoping pole, said at least one telescoping pole extends upward from said platform, said rotation member is rotationally engaged with a top of one of said at least one telescoping pole.

17. The chest peak contractor of claim 16 wherein:

the top of said at least one telescoping pole is terminated with a tee fitting, said rotation member is rotatably retained in said tee fitting.

18. The chest peak contractor of claim 15 wherein:

said first hanger includes a proximal outer tube and a proximal axle support tube, said proximal axle support tube is slidably received by said proximal outer tube, said first end of said armature crossbeam is attached to said proximal outer tube, said at least one axle is retained in said proximal axle support tube.

19. The chest peak contractor of claim 15 wherein:

said weight holder includes an outer tube, an inner tube and a weight projection, said outer tube is pivotally retained on said at least one axle, said outer tube is sized to receive said inner tube, said weight projection extends from a bottom of said inner tube.

* * * * *